United States Patent [19]

Schultz

[11] Patent Number: 4,503,086

[45] Date of Patent: Mar. 5, 1985

[54] DEVICE AND METHOD FOR UNIFORMLY CURING UV PHOTOREACTIVE OVERVARNISH LAYERS

[75] Inventor: Robert H. Schultz, Broomfield, Colo.

[73] Assignee: Adolph Coors Company, Golden, Colo.

[21] Appl. No.: 525,059

[22] Filed: Aug. 22, 1983

[51] Int. Cl.[3] ..... B05D 3/06

[52] U.S. Cl. ..... 427/54.1; 101/40; 118/620

[58] Field of Search ..... 427/54.1; 250/492.1; 34/4; 118/620, 642, 643; 101/40

[56] References Cited

U.S. PATENT DOCUMENTS

| | | | |
|---|---|---|---|
| 3,025,786 | 3/1962 | Johnson et al. | 101/44 |
| 3,766,851 | 10/1973 | Sirvet et al. | 101/40 |
| 3,960,073 | 6/1976 | Rush | 101/40 |
| 4,048,917 | 9/1977 | Skrypek et al. | 34/4 |
| 4,050,412 | 9/1977 | Bautz | 427/54.1 |
| 4,193,204 | 3/1980 | Nerod | 34/4 |
| 4,222,479 | 9/1980 | Dugan et al. | 101/40 |

*Primary Examiner*—John H. Newsome
*Attorney, Agent, or Firm*—Klaas & Law

[57] ABSTRACT

An apparatus for curing coatings on objects such as beverage cans in a single one step operation by moving the cans along a path which traverses a predetermined angle so that face portions of the can which are substantially aligned with the direction of travel are irradiated with substantially direct radiation. This radiation also cures the inside portions of the can as the can passes through the predetermined angle. Side portions of the can which face substantially transversely to the direction of motion of the cans are irradiated by separate side radiation curing devices.

23 Claims, 10 Drawing Figures

DEVICE AND METHOD FOR UNIFORMLY CURING UV PHOTOREACTIVE OVERVARNISH LAYERS

BACKGROUND OF THE INVENTION

The present invention pertains generally to ultra violet (uv) spectrum irradiation of overvarnish layers applied to containers and more particularly to radiation curing of cans to provide uniform curing of both inner and outer portions of the cans without rotation.

Beverage containers are normally formed from either two-piece containers or three-piece containers. Two-piece containers comprise a lid portion and a can body portion. In many cases, can body portions are formed by a cupping and ironing process utilizing sheet metal, such as sheet aluminum, which is lubricated with an oil/water emulsion coolant and then stamped into relatively short height and relatively large diameter cups. In the body making step, each cup is forced by a moving ram through a series of concentric ironing dies that stretch the cup to form a relatively taller height and relatively smaller diameter can body, approximating the size of the finished product cans. The can bodies are then trimmed and carried through a multiple stage can body washer which removes used coolant and metal fines from the can body. This process is more fully described in U.S. Pat. No. 4,027,685 issued June 7, 1977 to Heard et al, which is specifically incorporated herein by reference for all that it discloses.

After the can bodies are cleaned and dried in the multiple stage can body washer, the can bodies are sent to a decorator machine which applies decorative layers to the outer cylindrical surface of the can body, as generally described in U.S. Pat. No. 4,267,771 issued to James S. Stirbis on May 19, 1981, which is specifically incorporated herein by reference for all that it discloses. After the decorative layers are applied to the can body, an ultraviolet photoreactive overvarnish layer is applied to the entire outer cylindrical surface of the can body over the decorative layers. This overvarnish layer provides a protective layer to the decorative layers and also produces a shiny and aesthetic appearance to the decorative layers and aluminum surfaces of the outer cylindrical portions of the can body which have not been coated with a decorative layer. From the decorator machine the can bodies are then loaded onto a pin chain which supports the can bodies from the inner cylindrical surface. The can bodies then pass through an ultraviolet oven which irradiates the outer cylindrical surfaces of the can with ultraviolet radiation such as disclosed in U.S. Pat. No. 3,147,363 issued to Mohn et al. on Sept. 1, 1964, U.S. Pat. No. 3,733,709 issued to Bassemir on May 22, 1973, U.S. Pat. No. 3,745,307 issued to Peek et al. on July 10, 1973, U.S. Pat. No. 3,826,014 issued to Helding on July 30, 1974, U.S. Pat. No. 3,914,594 issued to Helding on Oct. 21, 1975 and U.S. Pat. No. 3,983,039 issued to Eastland on Sept. 28, 1976, which are specifically incorporated herein by reference for all that they disclose.

The photoreactive overvarnish coating applied by the decorator machine is specially formulated for curing by uv radiation in a process of uv photopolymerization. A particular advantage of using uv photoreactive coatings is that uv radiant sources can be easily employed in a high speed assembly line process. During application of the uv photoreactive overvarnish layer to the outer cylindrical portions of the can body, inner cylindrical portions as well as inner bottom portions of the can body also become coated, to some extent, by the overvarnish material. Since the uv photoreactive overvarnish material does not cure by simply allowing it to dry in the air, but only in response to uv radiation, the inner cylindrical portions and inner bottom portions of the can body must be irradiated with uv radiation to insure curing. Otherwise, the can body will be transported to the next stage of the can manufacturing process where a protective coating (FDA coating) is applied to the inner portions of the can to isolate the aluminum surfaces of the can body from the beverage to be contained within the can body. These protective coatings cannot be applied and uniformly cured on the inner surfaces of the can body if the overvarnish layer has not been previously cured. Consequently, uv radiation must be applied uniformly to both outside and inside portions of the can body to uniformly cure the overvarnish layer before the can bodies proceed to the next step in the fabrication process, since the photoreactive overvarnish coatings will not otherwise cure prior to application of additional layers such as the protective FDA inner coating.

In order to provide uniform curing of the outside portions of a cylindrical object, prior art devices have utilized pins which rotate the can as the can passes the radiation curing oven, such as disclosed in U.S. Pat. No. 3,840,999 issued to Whelan on Oct. 15, 1974, U.S. Pat. No. 3,894,237 issued to Choate et al. on July 8, 1975, and U.S. Pat. No. 4,129,206 issued to Talbott on Dec. 12, 1978, which are specifically incorporated herein by reference for all that they disclose. The can is then removed from the rotating pin and placed in a track so that the inside of the container can be irradiated by a separate oven. This arrangement requires numerous handling steps, including the use of several elevators and a complex rotating pin arrangement to achieve uniform curing of the uv photoreactive overvarnish layers.

To overcome these disadvantages and limitations, systems have been developed, such as disclosed in U.S. Pat. No. 4,208,587 by Eastland et al which provides a device for curing cylindrical objects, such as beverage containers, without rotation. Eastland et al utilizes a radiation source, such as a uv lamp, in a curved reflector which focuses radiant energy from the uv lamp onto a focal plane. The can body is then transported past the radiation source between the focal plane and the radiant source so that radiation impinges upon the cylindrical object before the radiation reaches the focal plane. In this manner, Eastland et al attempts to provide a broader distribution of radiation on the surface of the can body in an effort to achieve a more uniform curing of the outer cylindrical surfaces of the can body without rotation.

The disadvantages of non-rotating systems, such as disclosed by Eastland et al, are that in-line portions of the outer cylindrical surface of the can body, i.e., the outer portions of the can body that do not directly face the source of radiation, frequently do not receive sufficient radiant energy to achieve uniform curing of the uv photoreactive overvarnish layer. Non-uniform curing results from the inability of the radiation source and the reflector associated therewith to direct sufficient radiant energy onto the in-line portions of the can body. Consequently, the use of such non-rotating curing devices frequently results in the production of undercured coating on the outer cylindrical surface of the can body.

Moreover, such systems do not eliminate the necessity for use of additional ovens, the hardware associated therewith and the numerous handling steps required to cure the inner portions of the can body. In other words, although use of rotating pins and associated hardware is eliminated in non-rotating systems such as disclosed by Eastland et al, such systems frequently result in undercured outer surfaces of the can body and do not eliminate the necessity for an additional oven for curing the inner portions of the can body and the additional hardware and handling steps required.

Consequently, it would be advantageous to provide a system which is capable of uniformly curing uv photoreactive overvarnish layers on the outer cylindrical portions of can bodies, as well as inner portions of the can bodies in a simple one-step process which eliminates the complex hardware and handling steps required by conventional prior art devices.

OBJECTS OF THE INVENTION

It is therefore an object of the present invention to provide an apparatus for curing uv photoreactive coatings on objects.

It is also an object of the present invention to provide an apparatus for uniformly curing uv photoreactive coatings on beverage containers.

It is another object of the present invention is to provide a device for completely curing uv photoreactive overvarnish coatings on inner and outer portions of can bodies without rotation.

Another object of the present invention is to provide a device for curing uv photoreactive overvarnish coatings on inner and outer surfaces of can bodies which is simple and easy to implement.

Another object of the present invention is to provide a single device for pinchain unloading, external curing and internal curing of uv photoreactive overvarnish layers on can bodies.

Additional objects, advantages, and novel features of the invention are set forth in part in the description that follows and will be understood by those skilled in the art upon examination of this disclosure or may be learned by practice of the invention. The objects and advantages of the invention may be realized and obtained by means of the instrumentalities in combination particularly pointed out in the appended claims.

SUMMARY OF THE INVENTION

To achieve the foregoing and other objects and in accordance with the purposes of the present invention, as embodied and broadly described herein the apparatus of the present invention in general comprises an apparatus for uniformly and completely curing uv photoreactive coatings on can bodies comprising: vacuum belt means for transporting the can bodies along a curved path having a curvature which exposes face portions and inside portions of the can bodies to radiation emitted from a predetermined location which impinges upon the face portions and the inside portions of the can bodies at an angle of incidence sufficient to completely cure the uv photoreactive coatings on the face portions and the inside portions; top irradiator means disposed at the predetermined location for producing uv radiation to cure the uv photoreactive coatings on the face portions and inside portions of the can bodies; side irradiator means for irradiating side portions of the can bodies with uv radiation to completely cure uv photoreactive coatings on the side portions and achieve complete and uniform curing of uv photoreactive coatings on the can bodies.

The present invention may also comprise a method of uniformly curing uv photoreactive coatings on can bodies comprising the steps of: transporting the can bodies on a vacuum belt along a predetermined path having a predetermined portion which changes direction along an arcuate path by a predetermined angle; exposing the can bodies to uv radiation from at least one top uv irradiation source disposed radially outward from the arcuate path to cure the uv photoreactive coatings on face portions and inside portions of the can bodies; exposing the can bodies to uv radiation from at least one side uv irradiation source disposed along side portions of the predetermined path to cure the uv photoreactive coatings on side portions of the can bodies.

The advantages of the present invention are that radiation impinges in a substantially direct manner on both inside and outside portions of the can body to provide uniform and complete curing of the uv photoreactive overvarnish material using a simple conveying technique so as to eliminate a substantial number of machine handling devices such as elevators, can tracks, unloaders, pinchain rotators, vacuum pin strippers, rotary pinchain strippers, etc. Elimination of such devices results in reduced maintenance costs and increased productivity. Use of a vacuum belt to transport the cans eliminates the conventional pinchain conveyor normally used to transport the cans in front of the uv irradiators. Both the pins and cans have a range of movement which frequently causes the pins or cans to damage the uv irradiator tubes. The vacuum belt is less costly, more reliable in operation and causes fewer jams in the system. The uv irradiation tubes are expensive to replace and cause contamination when broken since they contain mercury vapor. The vacuum belt holds the can bodies in a manner which limits the range of motion of the can body so that the can bodies can be positioned substantially closer to the uv irradiation tubes for more efficient curing without risking breakage of the tubes. Also, since the cans are not rotated on pins, the spinner rail required to spin the pins is eliminated which allows use of a less expensive pin chain. Several elevators are also eliminated by the one-step process of the present invention which substantially reduces the maintenance costs associated with these elevators. Better curing provided by the present invention allows for greater abrasion resistance and a more attractive reflective appearance of the overvarnish layer on the can bodies.

DETAILED DESCRIPTION OF THE INVENTION

Figure 1:
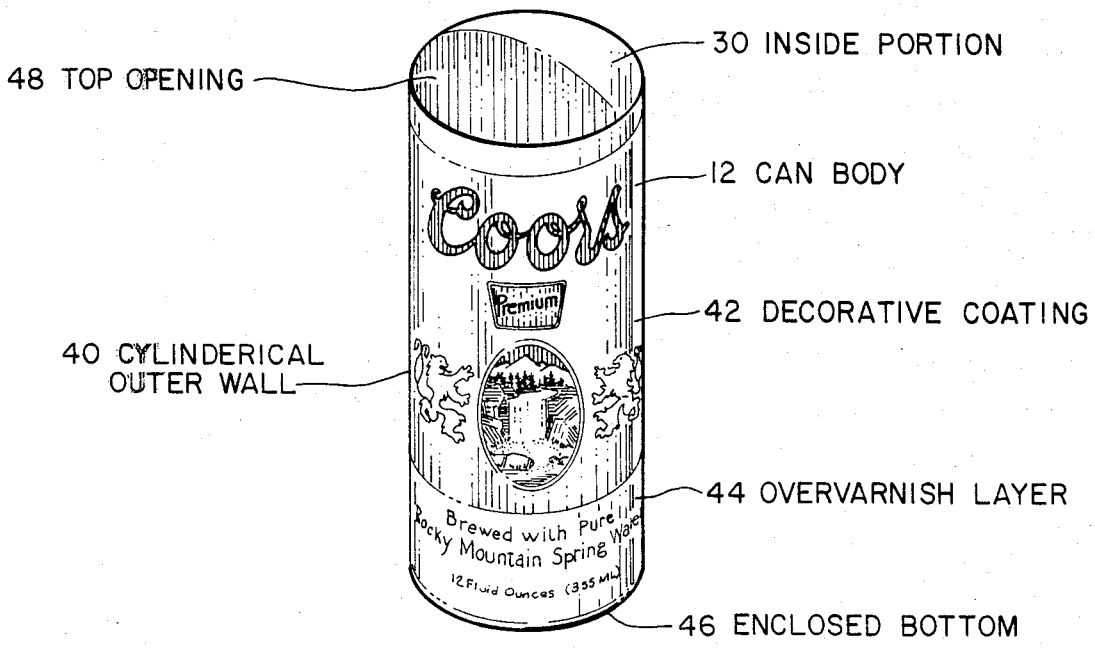
FIG. 1 is a schematic perspective view of a can body.

In general, the present invention utilizes vacuum belt means 10 which removes coated objects, such as can bodies 12, from an infeed conveyor 14 and transports the coated objects 12, along a predetermined path 16 which changes direction by a predetermined angle, such as 90°.

Ultraviolet irradiators are aligned to expose the can bodies to ultraviolet radiation as they travel along the predetermined path 16 such that the photoreactive material applied to the can bodies is uniformly and completely cured. Top irradiation curing means 18, 20 are disposed over a predetermined path 16 at a position where predetermined path 16 changes direction by a predetermined angle to achieve complete curing of photoreactive coating on both face portions 22 and 24, and inside portions 30 of the can body 12. Side irradiation curing means 32, 34, 36, 38 are disposed to irradiate side portions of the object to achieve complete and uniform curing of photoreactive coating on the can body.

Referring to FIG. 1, a can body 12 is illustrated which comprises one piece of a two piece container for containing food products such as beverages. Can body 12 has an outer cylindrical surface 40 having a decorative coating 42 applied thereto and an overvarnish layer over the decorative coating and remaining portions of the cylindrical outer wall 40 which functions as a protective coating and provides an aesthetic appearance to both the decorative coating and the metal portions of the can which are not covered by the decorative coating 42. Can body 12 is formed in a cutting and ironing process from sheet metal, such as aluminum, so that the can body has an enclosed bottom portion 46 and a top opening 48.

During application of the overvarnish layer 44 to can body 12 by a decorator machine (not shown), overvarnish material applied to the cylindrical outer wall 40 occasionally enters top opening 48 and becomes applied to inside portion 30 of can body 20. The overvarnish material may become applied to the inside portions 30 which include the cylindrical inner surface of the can body 12 and inner surface of enclosed bottom 46. Both the overvarnish layer 44 and decorative coating 42 are photoreactive coatings which cure by application of ultraviolet radiation.

Figure 2:
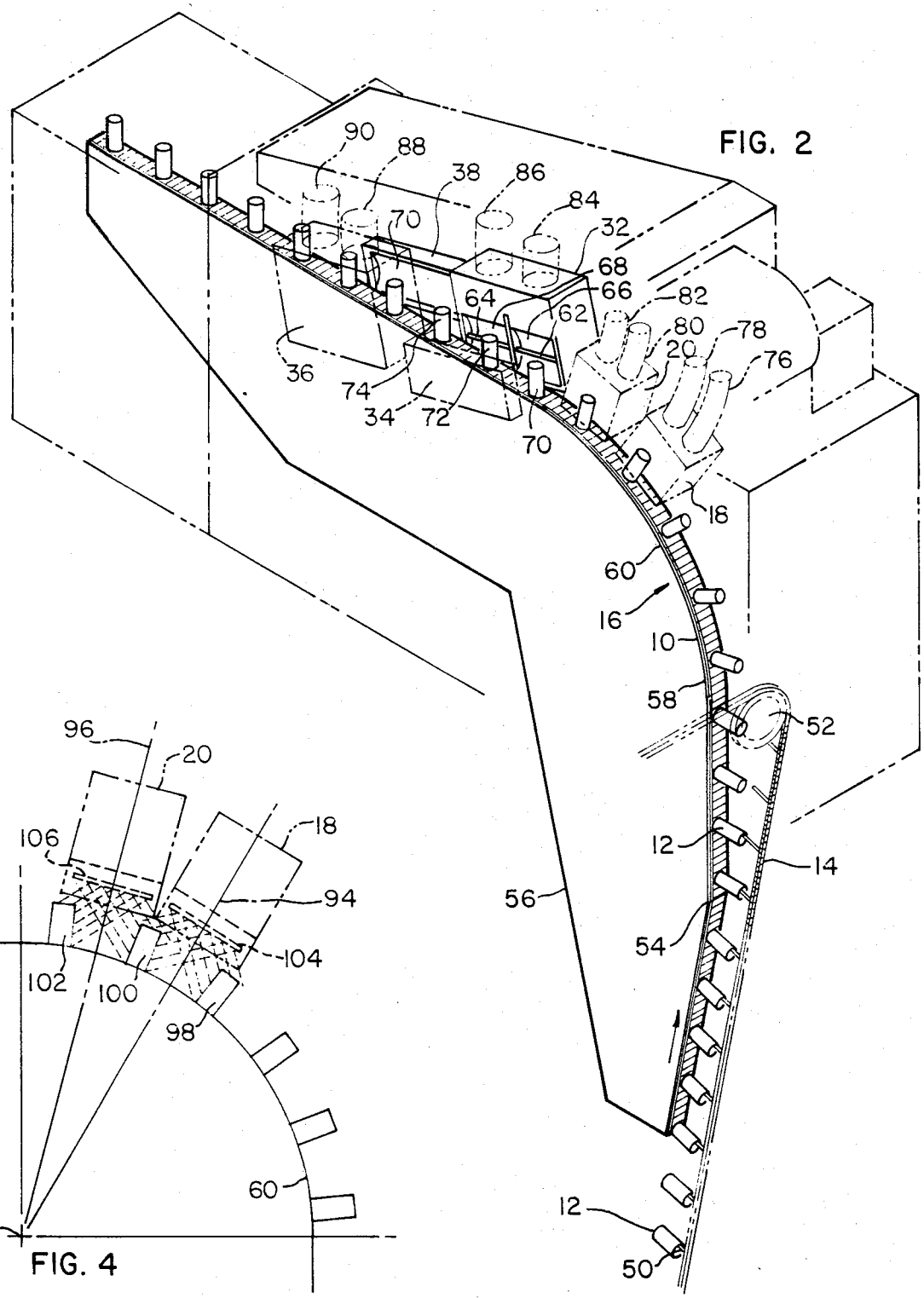
FIG. 2 is a schematic isometric view of the device of the present invention.

FIG. 2 is a schematic isometric view of the device of the present invention. Can bodies 12, which have a decorative coating 42 and an overvarnish layer 44 applied thereto, are loaded onto a series of pins 50 mounted on pin chain 14. Pins 50 are inserted through top opening 48 of can body 12 as the can bodies exit the decorator machine. Sprocket 52 redirects the pin chain 14 back to the decorator. Pin chain 14 is aligned with vacuum belt 10 so that the enclosed bottom portions 46 of the can bodies 12 are proximate to the vacuum belt 10, as illustrated in FIG. 2. A vacuum applied to plenum 56 draws air through slots in the vacuum belt 10 to remove the can bodies from pins 50 so that the can bodies become securely mounted on vacuum belt 10. Vacuum belt 10 follows a predetermined path 16 which changes direction at point 54 so that can bodies 12 gradually become disengaged from pin chain 14. Pulley 52 is mounted at a height sufficient to insure a complete disengagement of the can bodies 12 from pin chain 14. Vacuum belt 10 again changes direction at point 58 and proceeds along a predetermined arcuate path which causes can bodies 12 to change direction by a predetermined angle. As illustrated in FIG. 2, the predetermined arcuate path 60 changes direction by approximately 90°. Top irradiators 18 and 20 are positioned over the vacuum belt 10 and can bodies 12 in alignment with radial projections of arcuate path 60, as more clearly shown in FIG. 4.

Side irradiators 32 and 36 are positioned on opposite sides of vacuum belt 10 to irradiate side portions of can bodies 12. Curved reflectors 34 and 38 are positioned opposite to side irradiators 32 and 36, respectively, to reflect uv radiation onto face portions of can body 12. As illustrated in FIG. 2, side irradiator 32 contains two uv irradiation tubes 62 and 64 which are mounted adjacent to curved reflectors 66 and 68, respectively. Side irradiator 36 is constructed in a similar manner. Curved reflector 38 has a curved reflective surface 70 which functions to focus light from side irradiator 36 in a substantially horizontal direction, in the same manner as the curved reflective surfaces of side irradiators 32 and 36. As illustrated in FIG. 2, side irradiators 32 and 36, as well as curved reflectors 34, 38 are disposed at an inclined angle to vacuum belt 10. The inclination and alignment of side irradiators 32, 36 and curved reflectors 34 and 38 is such that an inclined zone of intensified radiation is produced which can bodies 12 traverse as the can bodies 12 travel along predetermined path 16. The inclined intensified zone of radiation is aligned to sequentially cure the entire length of the can body from top to bottom as the can bodies pass in front of the side irradiators and curve reflectors. To maximize efficiency, the intensified zone of radiation is aligned with the top portion of the can bodies 12 as the cans first pass between the side irradiator and opposed curve reflector and aligned with the bottom portion of the can bodies 12 as the can bodies exit the space between the side irradiator and the opposed curve reflector. For example, can bodies 70, 72 and 74 illustrate the manner in which the entire length of the can body is sequentially irradiated with ultraviolet radiation. Can body 70 illustrates the position in which upper portions of the can body are irradiated, while can body 72 illustrates a can body being irradiated along the center portions of the can body. Can body 74 is in a position for irradiation along bottom portions. A similar profile of irradiation occurs between side irradiator 36 and curve reflector 38.

Blower hoses 76–90 provide a source of forced air to cool the magnetron units and uv irradiator tubes in irradiators 18, 20, 32 and 36. The irradiators operate by producing microwave energy which impinges upon mercury vapor contained within the uv irradiator tubes. The mercury vapor produces ultraviolet radiation in response to the microwave RF energy produced by the magnetron units. The top irradiators 18 and 20, as well as side irradiators 32 and 36, are available from Fusion System Corporation, Rockville, Md.

Figure 3:
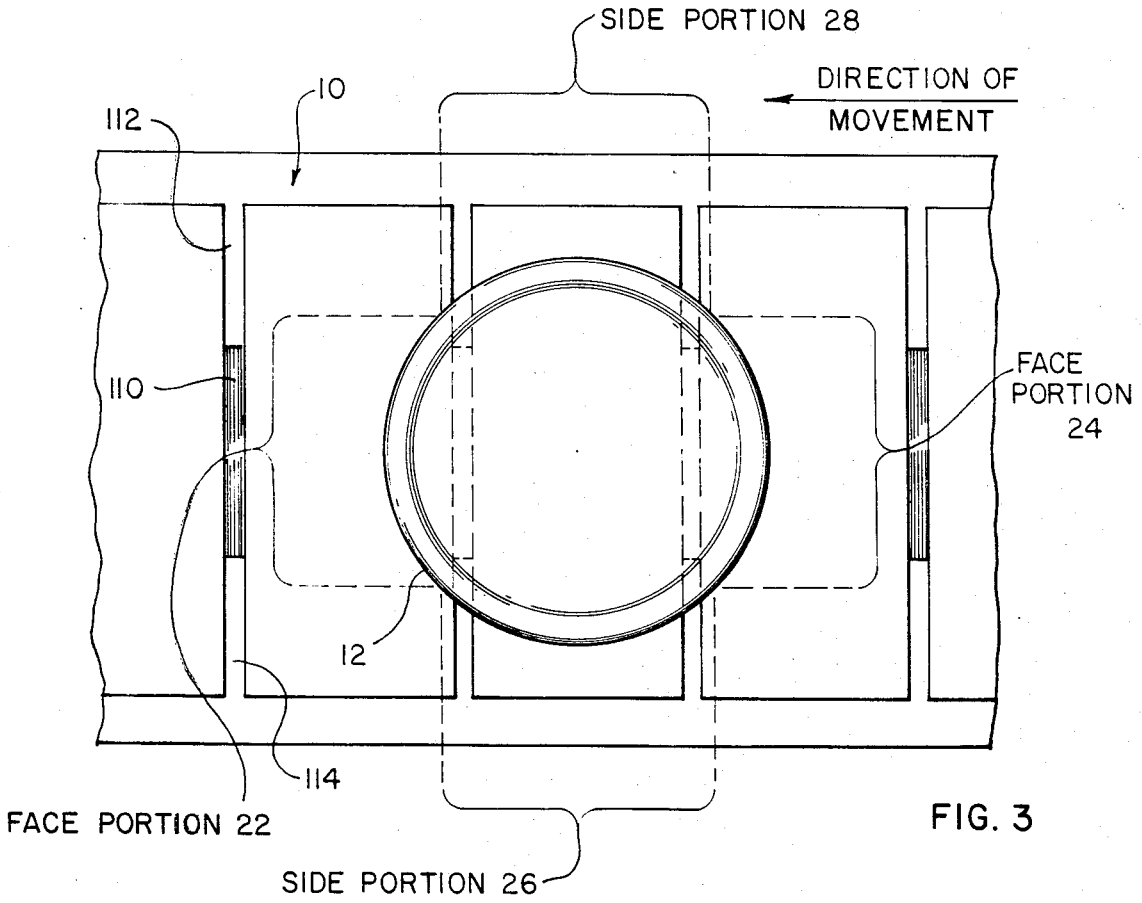
FIG. 3 is a schematic top view of a can body, such as illustrated in FIG. 1 on a vacuum belt.

FIG. 3 is a top view of a can body 12 disposed on a vacuum belt 10. Can body 12 is positioned on vacuum belt 10 from pin chain 14, as illustrated in FIG. 2. Vacuum belt 10 moves along in a predetermined direction of movement, as illustrated in FIG. 3. Face portions 22 and 24 are aligned with the direction of movement, while side portions 26 and 28 are aligned essentially transverse to the direction of movement. The side irradiators and curved reflectors 32–38 essentially irradiate side portions 26, 28, while face portions 22, 24 as well as inside portion 30 are irradiated by top irradiators 18, 20.

Figure 4:
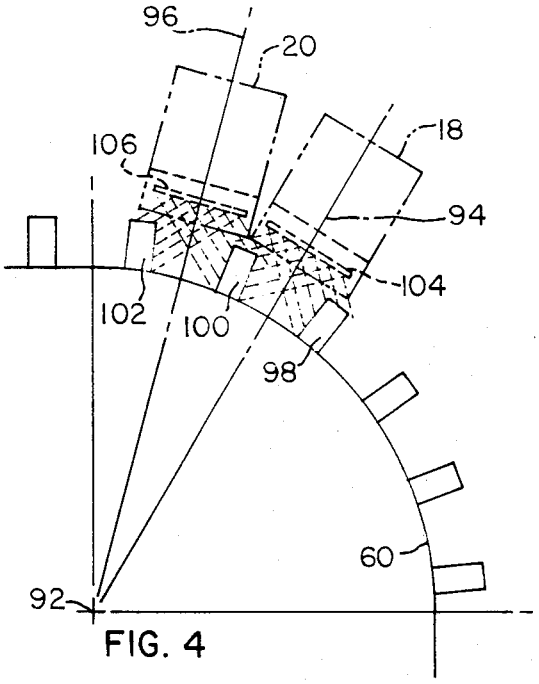
FIG. 4 is a schematic side view of the vacuum belt track illustrating the alignment of the top irradiators.

FIG. 4 is a schematic illustration of the manner in which top irradiators 18, 20 are aligned with arcuate path 60. As illustrated in FIG. 4, the center of the radius of curvature of arcuate path 60 is radial point 92. Top irradiator 18 is aligned with a ray 94 which projects from radial point 92. Similarly, top irradiator 20 is aligned with ray 96 which is also aligned with radial point 92. Irradiator tubes 104, 106 are positioned in top irradiators 18 and 20 such that face portions 22, 24, as well as inside portions 30 of the can bodies 12, are irradiated as they pass beneath top irradiators 18, 20. For example, can body 98 is irradiated on face portion 22, while can body 102 is irradiated on face portion 24. Can body 100 is irradiated simultaneously on face portions 22 and 24. Can bodies aligned with radial projections 94 and 96 are irradiated on inside portions 30 which include the cylindrical inner surface and the inner surface of the enclosed bottom 46. Consequently, both face portions 22, 24 and inside portions 30 of the can are completely irradiated by top irradiators 18 and 20. Arcuate path 60 allows the can bodies to be angled outwardly from adjacent cans by an amount proportional to the radius of curvature of arcuate path 60. This provides for greater exposure of face portions of can body 12 to the uv curing radiation produced by irradiators 18, 20. Of course, since can bodies 12 gradually proceed beneath top irradiators 18 and 20, inside portions as well as outside face portions are progressively cured by radiation which is incident to the inside and outside surfaces of the cans, at various angles, to provide uniform curing.

Figure 5:
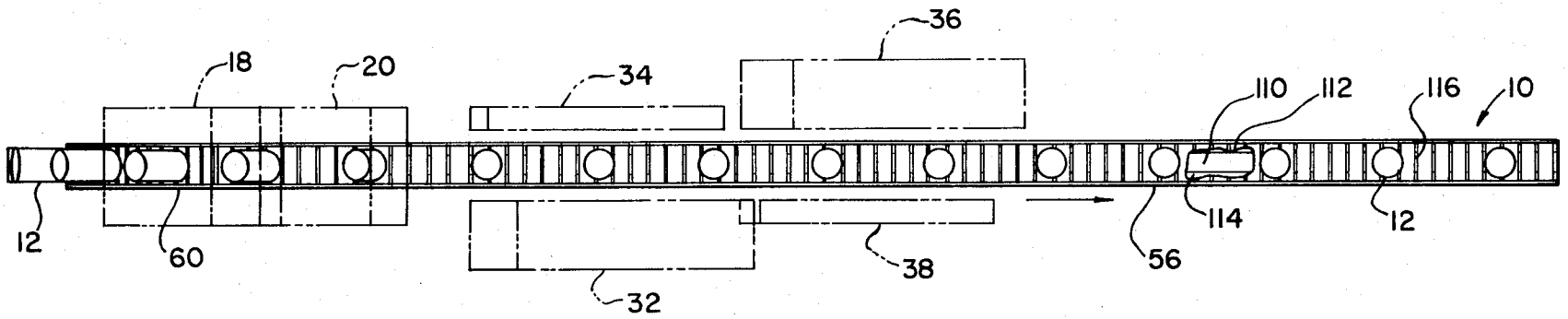
FIG. 5 is a schematic top view of the vacuum belt track illustrating the arrangement of irradiators.

FIG. 5 is a schematic top view of vacuum belt 10 illustrating the position of can bodies 12 with respect to top irradiators 18, 20, and side irradiators and curve reflectors 32–38. As shown in FIG. 5, top irradiators 18 and 20 are disposed over the top of vacuum belt 10 to irradiate face portions 22, 24 and inside portions 30 of can bodies 12 as they proceed along arcuate path 60. Top irradiators 18 and 20 provide complete curing of face portions 22, 24 and inside portions 30 of can bodies 12. Side irradiators 32, 36 and curved reflectors 34, 38 cure side portions of can bodies 12 as the can bodies 12 proceed along vacuum belt 10 in the direction indicated. Side irradiator 36 is disposed on the opposite side of vacuum belt 10 from side irradiator 32 to insure equal and complete curing of both side portions of can bodies 12.

FIG. 5 also illustrates the manner in which vacuum belt 10 is positioned on plenum 56. Plenum 56 has slot side portions 112, 114 which form a vacuum slot 110. A vacuum is applied to plenum 56 causing air to be drawn through vacuum slot 110 and chain plate slots 116 in vacuum belt 10. The resultant vacuum at slots 116 causes enclosed bottom portion 46 of can bodies 12 to be drawn against vacuum chain 10 and held in position. Vacuum belt 10, and the manner in which it is positioned in vacuum slot 110, is more clearly illustrated in FIGS. 6 and 7.

Figure 6:
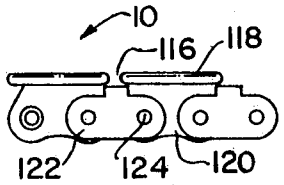
FIG. 6 is a schematic side view of a vacuum belt utilized with the present invention.

FIG. 6 comprises a schematic side view of vacuum belt 10. Vacuum belt 10 comprises face plates 118 which are coupled to chain portions 120. Interconnecting chain portions 122 couple chain portions 120 together to form vacuum belt 10. Pivot points 124 are equally spaced to provide a standard chain having a predetermined pitch. For example, the present invention preferably utilizes a chain pitch of $\frac{3}{4}$ inch and face plates having a width of $1\frac{3}{8}$ inches. This provides for a chain plate slot 116 of $\frac{1}{8}$ inch. Since the can bottom diameter is $2\frac{1}{2}$ inches and the chain plate width is $1\frac{3}{8}$ inch, the cans are always disposed over at least one chain plate slot 116 and consequently held in position by the vacuum applied to plenum 56.

Figure 7:
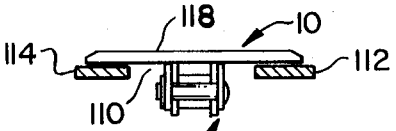
FIG. 7 is a schematic end view of the vacuum belt utilized in accordance with the present invention.

FIG. 7 is an end view of vacuum belt 10. As shown in FIG. 7, face plate 118 has a length sufficient to extend beyond vacuum slot 110 formed by slot side portions 112, 114. Chain portion 126 of vacuum belt 10 is sufficiently narrow to fit within vacuum slot 110. A vacuum applied to plenum 56 causes a low pressure zone below slot side portions 112, 114 causing air to pass through chain plate slots 116. Vacuum belts, such as illustrated in FIGS. 6 and 7, which are suitable for use with the present invention, comprise the 864 series straight running chain available from Rexnord, Milwaukee, Wisc.

Figure 8:
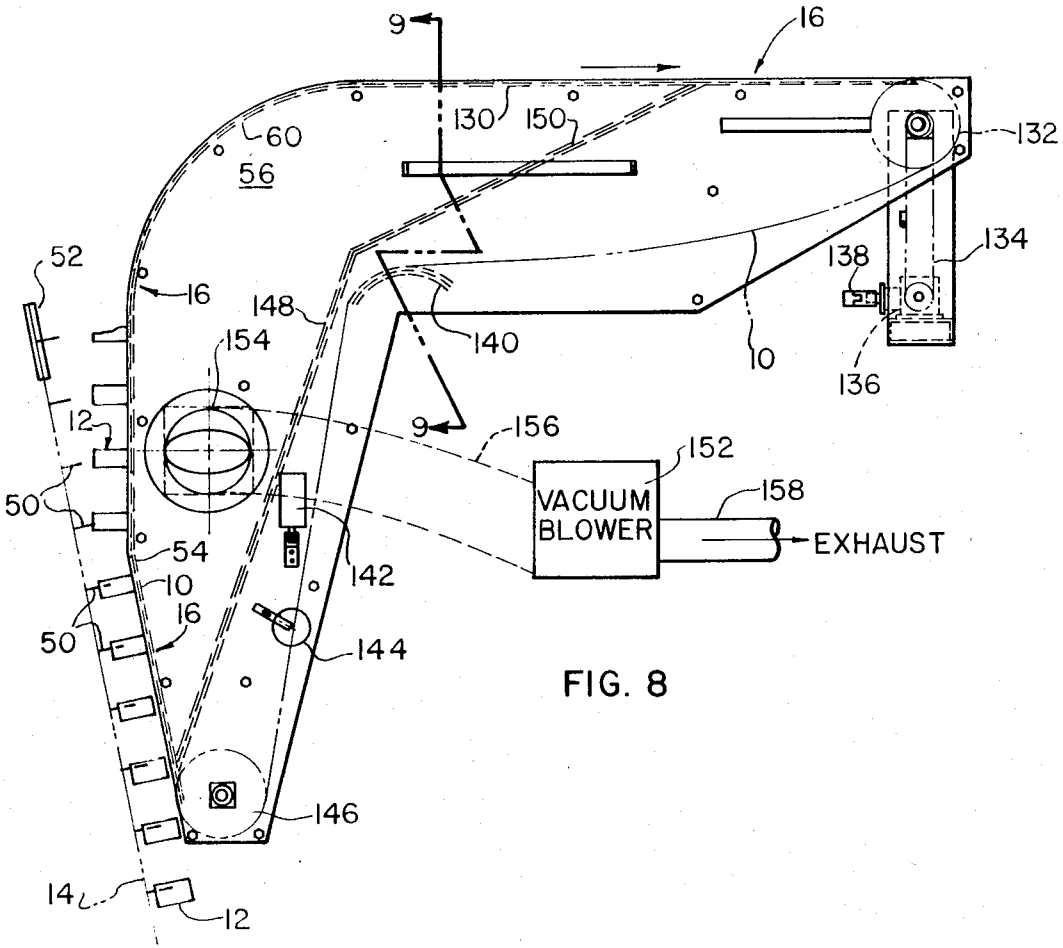
FIG. 8 is a schematic side view of the vacuum belt and vacuum chamber utilized in accordance with the present invention.

FIG. 8 is a reverse schematic view of the moving portions of the present invention. As set forth above, can bodies 12 are transported on pin chain 14 to a location proximate to vacuum belt 10. Vacuum belt 10 draws the can bodies 12 from pins 50 as the predetermined path 16 changes direction at point 54 so as to disengage can bodies 12 from pins 50. Pin chain 14 is directed around sprocket 52 and returned to the decorator. Vacuum belt 10 proceeds along predetermined path 16 and around arcuate path 60 to straight portion 130. Vacuum belt 10 is coupled to drive sprocket 132 which drives vacuum belt 10 at a predetermined speed. Drive chain 134 is coupled to gear box 136 which receives power from shaft coupler 138. Vacuum belt 10 is engaged by chain return guide 140 and directed across lubricator 142, and lubricator brush 144 which maintain proper lubrication of vacuum belt 10. Vacuum belt 10 is then engaged by idler sprocket 146 which redirects vacuum belt 10 along predetermined path 16.

Plenum chamber 56 is enclosed by plenum walls 148, 150, side walls 160, 162 (FIG. 9) and vacuum belt 10 disposed in vacuum slot 110. Vacuum blower motor 152 is coupled to plenum chamber 56 through damper 154. Vacuum coupler 156 comprises an airtight coupling unit capable of transporting air exhausted from plenum chamber 56 to vacuum motor 152. Exhaust coupler 158 functions to exhaust air from exhaust motor 152 to an exterior portion of the building.

Figure 9:
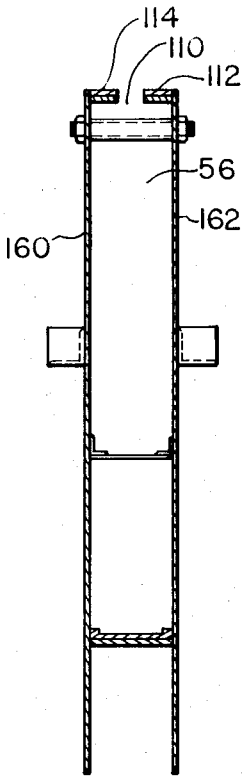
FIG. 9 is a cross-sectional view of the vacuum chamber illustrated in FIG. 8.

FIG. 9 is a cross-sectional view of the device illustrated in FIG. 8. As shown in FIG. 9, plenum chamber 56 is formed from side wall portions 160, 162. Vacuum applied to damper 154 creates a low pressure area in plenum chamber 56 causing air to be drawn through vacuum slot 110 defined by slot side portions 112, 114. Vacuum belt 10 is disposed in vacuum slot 110, in the manner illustrated in FIG. 7, to cause air to be drawn through chain plate slots 116 and hold the can bodies in place.

Figure 10:
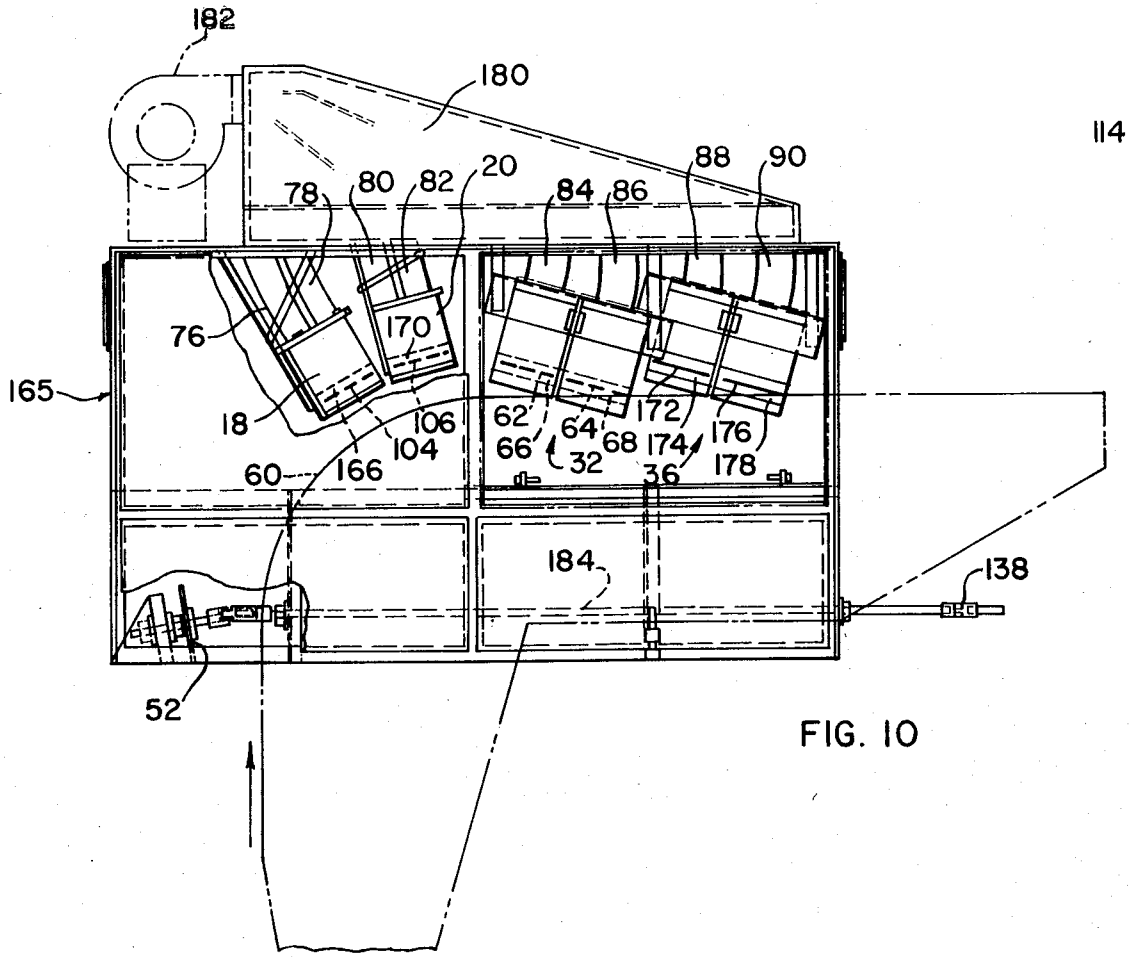
FIG. 10 is a side view of the irradiation chamber of the present invention.

FIG. 10 is a schematic cut-away illustration of the irradiation chamber 165 of the present invention. The predetermined path 16 is superimposed in FIG. 10 to show the position of vacuum belt 10 with regard to top irradiators 18, 20 and side irradiators 32, 36. Top irradiator 18 has a uv radiation tube 104 disposed in a curved reflective cavity 166 having an axis parallel to the tangent of the direction of travel of the vacuum belt along arcuate path 60. Top irradiator 20 has a similar uv irradiation tube 106 disposed in a curved reflective surface 170 which is aligned in the same manner. Side reflector 32 has uv irradiation tubes 62, 64 disposed in curved reflective surfaces 66, 68. In a similar manner, side irradiator 36 has uv irradiation tubes 172, 176 disposed in curved reflective surfaces 174, 178, respectively. The upper most portion of uv irradiation tubes 62 and 172 are aligned with top portions of can bodies 12 as the can bodies pass along predetermined path 16. In a similar manner, the lower most portions of irradiation tubes 64 and 176 are aligned with bottom portions of can bodies 12 as the can bodies pass along predetermined path 16 on vacuum chain 10. In this manner, the entire length of side portions of the can bodies 12 are progressively irradiated by the side irradiators.

Blower 182 is attached to manifold 180 to supply a source of air to blower hoses 76–90. The supply of air is used to cool the magnitrons and irradiation tubes of the irradiators to maintain a predetermined operating temperature. The supply of air is drawn from the irradiators through the vacuum belt 10 into plenum 56 and exhausted through the exterior of the building by exhaust coupler 158 (FIG. 8). In this manner, ozone produced by the uv radiation is removed from the irradiation chamber 165 to reduce the ozone content of the surrounding area.

FIG. 10 also illustrates the manner in which power is coupled from pin chain sprocket 52 by drive shaft 184 to shaft coupler 138. As illustrated in FIG. 8, shaft coupler 138 is coupled to gear box 136 to provide power to vacuum belt 10. In this manner, the movement of vacuum belt 10 is synchronous with pin chain 14.

The foregoing description of the invention has been presented for purposes of illustration and description. It is not intended to be exhaustive or to limit the invention to precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. An apparatus for uniformly and completely curing uv photoreactive coatings on can bodies comprising:

vacuum belt means for non-rotatably holding said can bodies by external bottom portions and transporting said can bodies along a curved path having a curvature which exposes face portions and inside portions of said can bodies to radiation emitted from a predetermined location which impinges upon said face portions and said inside portions of said can bodies at an angle of incidence sufficient to completely cure said uv photoreactive coating on said face portions and said inside portions, said face portion being substantially aligned with the direction of travel of said can bodies;

first irradiator means disposed at said predetermined location for producing uv radiation to cure said uv photoreactive coatings on said face portions and inside portions of said can bodies;

second irradiator means for irradiating side portions of said can bodies with uv radiation to completely cure uv photoreactive coatings on said side portions and achieve complete and uniform curing of uv photoreactive coatings on said can bodies;

whereby the axis of said can bodies is substantially parallel to the plane of said curved path.

2. The apparatus of claim 1 wherein said first irradiator means comprises at least two radiation sources for directing radiation from at least two directions.

3. The apparatus of claim 1 wherein said second irradiator means comprises:

focused radiation source means disposed on a first side of said vacuum belt means for irradiating a first side portion of said can bodies;

reflector means disposed on a side opposite to said first side of said vacuum belt means for irradiating a second side portion of said can bodies.

4. The apparatus of claim 3 further comprising cooling means for imparting an air flow across said radiation curing means and said additional radiation curing means.

5. The apparatus of claim 4 further comprising vacuum blower means for providing a vacuum for said vacuum belt means.

6. The apparatus of claim 5 further comprising vacuum chamber means coupled to said vacuum blower means for providing a low pressure to said vacuum belt means.

7. The apparatus of claim 6 further comprising:

pin chain means for transporting coated beverage containers from a coating apparatus, said pin chain means disposed to synchronously interface with said vacuum belt means such that said vacuum belt means removes said beverage containers from said pin chain means.

8. The apparatus of claim 1 wherein said curved path comprises an arcuate path.

9. The apparatus of claim 8 wherein said predetermined location comprises a position aligned with a radial projection of said arcuate path.

10. An apparatus for uniformly curing uv photoreactive coatings on can bodies comprising:

vacuum belt means for non-rotatably holding said can bodies by external bottom portions and transporting can bodies along a predetermined path which changes direction by a predetermined angle along a predetermined portion of said predetermined path;

first irradiator means aligned to irradiate face portions and inside portions of said can bodies along said predetermined portion of said predetermined path to completely and uniformly cure said uv photoreactive coatings on said face portions and inside portions of said can bodies, said face portions being substantially aligned with the direction of travel of said can bodies;

second irradiator means for irradiating side portions of said can bodies to uniformly and completely cure said uv photoreactive coatings on said side portions of said can bodies;

whereby the axis of said can bodies is substantially parallel to the plane of said predetermined path.

11. The apparatus of claim 10 wherein said predetermined angle is approximately 90°.

12. The apparatus of claim 1 further comprising:

drive means for synchronously driving said vacuum belt means and said pin chain means.

13. The apparatus of claim 10 wherein said second irradiator means comprises:

at least one side irradiator aligned to irradiate at least one side portion of said can bodies;

at least one side reflector aligned with said side irradiator to irradiate an opposite side portion of said can bodies.

14. The apparatus of claim 10 wherein said predetermined portion changes direction along a predetermined arcuate path.

15. The apparatus of claim 14 wherein said first irradiator is disposed radially outwardly from said arcuate path.

16. The apparatus of claim 15 further comprising:

pin chain means for transporting said can bodies from a coating apparatus, said pin chain means disposed to synchronously interface with said vacuum belt means such that said vacuum belt means removes said can bodies from said pin chain means.

17. The apparatus of claim 16 further comprising:

blower means for cooling said first and second irradiator means with a supply of forced air.

18. The apparatus of claim 17 further comprising:

plenum chamber means for providing a substantially enclosed vacuum chamber;

vacuum slot means formed in said plenum chamber means, said vacuum belt means disposed in said vacuum slot means;

vacuum generator means for removing air from said plenum chamber means to generate suction through said vacuum belt means to hold said can bodies on said vacuum belt means.

19. A method of uniformly curing uv photoreactive coatings on can bodies comprising the steps of:

non-rotatably holding said can bodies by external bottom portions on a vacuum belt;

transporting said can bodies on said vacuum belt along a predetermined path having a predetermined portion which changes direction along an arcuate path by a predetermined angle;

exposing said can bodies to uv radiation from at least one uv irradiation source aligned radially outward from said arcuate path to cure said uv photoreactive coatings on face portions and inside portions of said can bodies, said face portions being substantially aligned with the direction of travel of said can bodies;

exposing said can bodies to uv radiation from at least one uv irradiation source disposed along side portions of said predeterminerd path to cure said uv photoreactive coatings on side portions of said can bodies;

whereby the axis of said can bodies is substantially parallel to the plane of said predetermined path.

20. The method of claim 19 comprising the further step of:

aligning at least one uv irradiation source with radial projections from the center of said arcuate path.

21. The method of claim 20 further comprising the steps of:

generating a vacuum;

applying said vacuum to said vacuum belt to hold said can bodies on said vacuum belt.

22. The method of claim 21 further comprising the steps of:

transporting said can bodies on a pin chain from a device for applying said uv photoreactive coatings;

removing said can bodies from said pin chain by transporting said can bodies on said pin chain proximate to said vacuum belt.

23. The method of claim 22 further comprising the steps of:

synchronously driving said pin chain and said vacuum belt.

* * * * *